US005267900A

United States Patent [19]

Clayton

[11] Patent Number: 5,267,900

[45] Date of Patent: Dec. 7, 1993

[54] TELEPHONE MESSAGE RECORDING DEVICE AND METHOD

[76] Inventor: Terry W. Clayton, 4327 245th Ave. SE., Issaquah, Wash. 98027

[21] Appl. No.: 819,262

[22] Filed: Jan. 10, 1992

[51] Int. Cl.[5] ..... B41L 1/26

[52] U.S. Cl. ..... 462/14; 462/9; 462/10; 462/27; 462/29; 462/32

[58] Field of Search ..... 462/9, 10, 11, 13, 14, 462/16, 27, 28, 29, 31, 32, 43, 46, 47, 48, 49

[56] References Cited

U.S. PATENT DOCUMENTS

| | | | |
|---|---|---|---|
| 538,288 | 4/1895 | Shoup et al. | 462/32 X |
| 626,896 | 6/1899 | Freeland | 462/27 |
| 639,635 | 12/1899 | Van Ame | 462/9 |
| 772,672 | 10/1904 | Reiter | 462/29 |
| 879,082 | 2/1908 | Cave | 462/9 |
| 960,733 | 6/1910 | Thomsen | 462/27 |
| 1,346,479 | 7/1920 | Bell | 462/10 |
| 1,551,930 | 9/1925 | Buchheim . | |
| 1,730,597 | 10/1929 | Williams . | |
| 1,743,372 | 1/1930 | Moran . | |
| 1,974,874 | 9/1934 | Miller . | |
| 2,520,707 | 8/1950 | Barrett | 462/29 |
| 2,680,029 | 6/1954 | Gintovt . | |
| 3,807,770 | 4/1974 | Bosland et al. . | |

FOREIGN PATENT DOCUMENTS 234855 6/1925 United Kingdom ..... 462/29

OTHER PUBLICATIONS

*Miller's Office Products,* Catalog (Circo 1989) pp. (548-550), Miller's Office Products, Arlington, Va.

*Primary Examiner*—Paul A. Bell

*Attorney, Agent, or Firm*—Craine & Jackson

[57] ABSTRACT

A method and device is described for recording and storing handwritten telephone messages. The device comprises a box structure which houses a roll of duplicating recording paper having a top sheet and a continuous bottom sheet. The roll of paper is unrolled in the box structure and across a writing surface visible through the window area on a front cover plate attached over the front portion of the box structure. The user records the message on one of a plurality of message outlines on the top sheet in the window area. The leading edge of the bottom sheet is attached to a sleeve member also housed inside the box structure. A handle is attached to the sleeve member which is used to selectively rotate the sleeve member to collect the bottom sheet thereon forming a collection spool which may be removed from the box structure and stored in a convenient location.

7 Claims, 3 Drawing Sheets

TELEPHONE MESSAGE
FOR:
FROM:
RE:
PHONE:
SIGNED:
DATE:
TIME:
TELEPHONE MESSAGE
FROM:
RE:
PHONE:
SIGNED:
DATE:
TIME:

TELEPHONE MESSAGE RECORDING DEVICE AND METHOD

TECHNICAL FIELD

This invention relates to devices and methods used to record, transfer, and store handwritten information. More particularly, this invention relates to devices and methods used to record, transfer, and store handwritten telephone messages.

BACKGROUND ART

In spite of the recent advances in computers, the production, transfer, and storage of handwritten information between individuals is still very important. In a business office, for example, a secretary or receptionist is still often required to record telephone messages for other individuals in the office. The telephone message information must be recorded accurately and given to the intended receiver within a reasonable time period. In many offices, it is desirable to keep a copy of each telephone message for later use.

Today, telephone message books are commonly used to record written telephone messages. Such telephone message books are relatively large, book-like structures with seventy-five to one hundred bound recording page units. Each recording page unit comprises a top and bottom page made of "NCR" (No Carbon Required) paper with each page having three to four message outlines printed thereon. The message outlines on the top and bottom pages are aligned and registered so that when a message is recorded on the top page, a duplicate copy of the message is automatically made on the bottom page. In addition, the message outlines on the top page are separated by perforating lines so that the user can remove the message outline from the top page and deliver it to the intended receiver.

Unfortunately, there are several, widely known problems associated with using typical telephone message books. First, such telephone message books are relatively large objects and therefore occupy a large amount of valuable desk top space. Second, a hard, flat surface must be placed under the bottom page of the top recording page unit so that the message duplicated on the bottom page is sufficiently dark to read. In addition, during normal use the messages are written on the top page of the top recording page unit which is placed over the unused recording page units. A hard surface must be placed under the bottom page of the top recording page unit so that the message is not duplicated on lower recording page units.

A third problem associated with typical telephone message books is that used bottom pages having old telephone messages recorded thereon, may be easily tattered or torn or accidentally removed. This, of course, makes retrieval of the old recorded messages on the bottom pages difficult or impossible.

A fourth problem associated with typical telephone message books is storage of a large number of old telephone message books and the retrieval of the old telephone messages therefrom. In order to retrieve old telephone messages, it is desirable that the used telephone message books be stored in a convenient location. Also, the process for retrieving individual messages from the used telephone message books should be relatively easy. In offices in which a relatively large number of telephone messages are recorded, storing a large number of used telephone message books in a convenient location can be difficult. Also, retrieving individual messages from a large number of used telephone message books can be difficult and time consuming.

A telephone message device and method which addresses and solves these and other problems otherwise appreciated, would be highly desirable.

DISCLOSURE OF INVENTION

It is a general object of the present invention to provide a method and device for recording telephone messages which addresses and satisfies the problems associated with typical telephone message books.

The device, disclosed herein, is designed to record and store written telephone messages. The device comprises a box structure which houses an exchangeable roll of duplicating recording paper. The roll of duplicating recording paper is positioned inside the box structure with its longitudinal axis perpendicular to the box structure's fore to aft axis. During use, the roll of duplicating recording paper is unwound as the duplicating recording paper is advanced through the box structure. The duplicating recording paper itself comprises two-layered "NCR" duplioating paper having a top sheet and a continuous bottom sheet each having a plurality of telephone messages outlines printed thereon. During manufacturing, the top and bottom sheets are registered so that the telephone message outlines printed on the top sheet are aligned with the telephone message outlines printed on the bottom sheet. The message outlines printed on the top sheet are separated by a perforated line which allows the user to remove the message coupon from the top sheet and deliver it to the intended receiver.

The free, leading edge of the bottom sheet of the duplicating recording paper is attached by an attachment means to sleeve member housed inside the box structure. A rotating means is attached to the sleeve member which selectively rotates the sleeve member to wind the bottom sheet thereon during use. As the bottom sheet is wound on the sleeve member, the duplicating recording paper is unwound from the roll of duplicating recording paper and advanced through the box structure.

As the duplicating recording paper is advanced through the box structure, a section of the duplicating recording paper is exposed in the window area located on the front cover plate. The user writes a telephone message on the message outline printed on the section of duplicating recording paper exposed in the window area. When a telephone message is written on the top sheet, it is automatically recorded on the message outline on the bottom sheet. As discussed further below, the rotating means is used to rotate the sleeve member to collect the paper thereon and also advances the paper in the box structure to expose a new message outline in the window area. As the duplicating recording paper is advanced beyond the window area, the top sheet is separated from the bottom sheet by a tongue member that extends downward from the forward extending edge of the rear cover plate. The tongue member causes the top sheet to move upward and extend through the paper slot located between the front and rear cover plates. The rearward extending edge of the front cover plate may be sharpened to form a cutting edge thereon which enables the user to tear the message coupon on the top sheet along the perforating line located between the message coupons.

In one embodiment, an optional information panel containing a date and time indicator is attached to the top surface of the rear cover plate.

As the bottom sheet is collected on the sleeve member, a collection spool comprising the continuous bottom sheet is formed in the box structure. When the last message outline has been used, the collection spool is then removed from the device. Because the collection spool is relatively small and more compact than typical telephone message books, it is easier to store in a convenient location. Also, since all of the messages are recorded on the continuous bottom sheet, all of the messages may be retrieved in an easy manner by simply unrolling the collection Spool until the desired message is found.

After the collection spool has be removed from the box structure, a new roll of duplicating recording paper and a new sleeve member are inserted.

Using the above described device, a method of recording telephone messages is provided. The method comprises the following steps: (1) installing a roll of duplicating recording paper having a top and bottom sheet in a box structure, the roll of duplicating recording paper being position in the box structure so that the duplicating recording paper from the roll is unroll along the fore to aft axis of the box structure; (2) attaching the leading edge of the bottom sheet of duplicating paper having a top and a bottom sheet to the sleeve member; (3) rotating the sleeve member to collect the bottom sheet thereon and to form a collection spool, as the sleeve member is rotating the roll of duplicating recording paper is unrolled and a new portion of the duplicating recording paper is thereby exposed; (4) writing a telephone message on the top sheet of the exposed portion of the duplicating recording paper; (5) removing said top sheet of said duplicating recording paper having said telephone message written thereon from said bottom sheet and delivering it to the intended receiver; (6) repeating steps (3) through (5) until all of the bottom sheet of duplicating recording paper has been collected on the sleeve member; (7) removing the collection roll from the box structure and storing it in a convenient location for later use.

The above method could include after step 4, step (4*a*) in which the sleeve member is rotated to expose a new portion of the duplicating recording paper. Also, the method could include after step (4a), step (4b) in which the top sheet of the duplicating recording paper having telephone message written thereon is separated from the bottom sheet of the duplicating recording paper;

The main advantages of the device and method disclosed above, include: (1) the user is able to record telephone messages more easily and conveniently than with typical telephone message books; (2) the user is able to record, store and retrieve the telephone messages more easily and conveniently than with typical telephone message books, and; (3) since the rolls of duplicating recording paper are cheaper to manufacture and supply than typical telephone message books, the device and method are less expensive than typical telephone message books.

BEST MODE FOR CARRYING OUT THE INVENTION

Figures 1, 2:
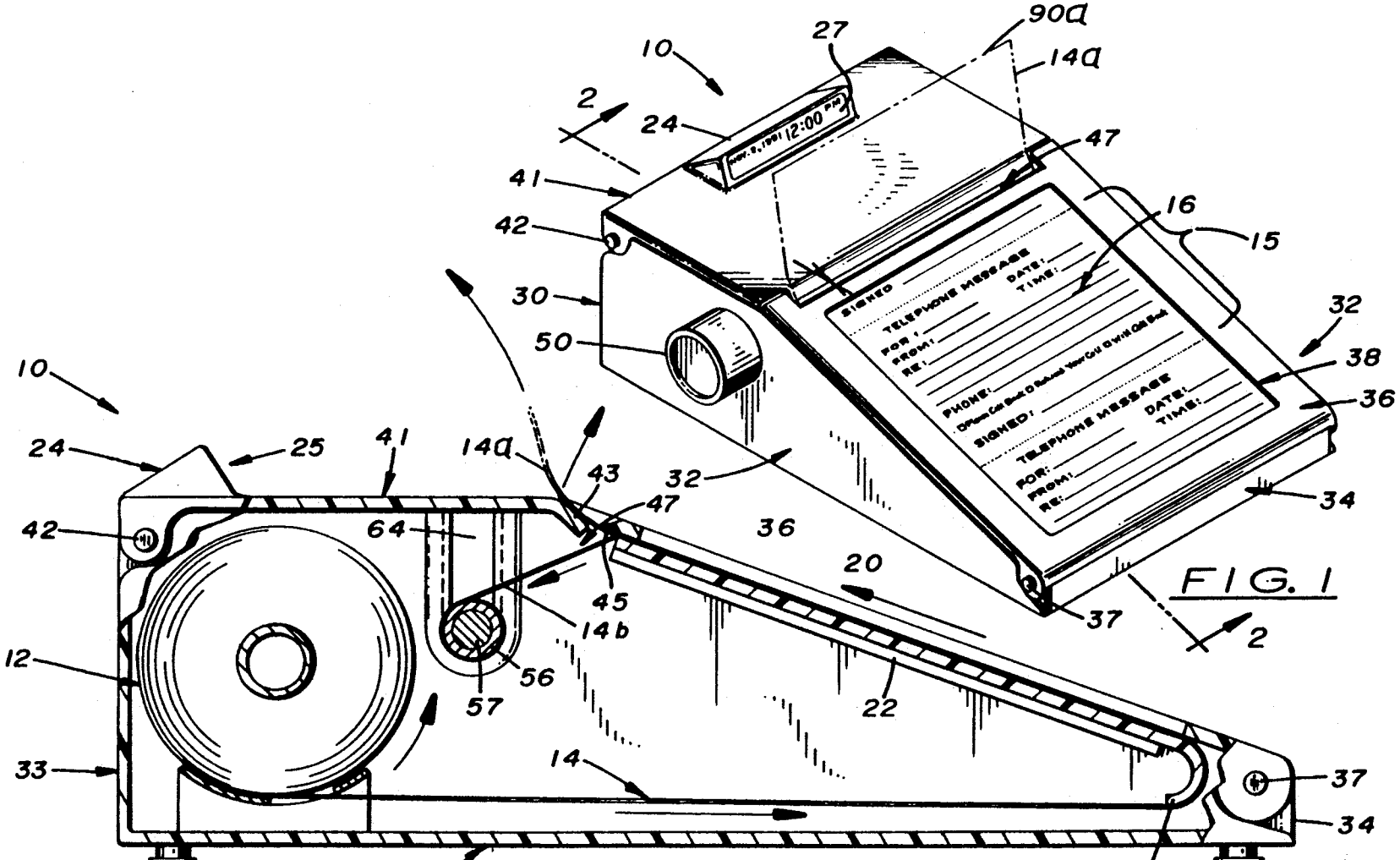
FIG. 1 is a perspective view of the invention disclosed herein.
FIG. 2 is a side elevational view, partially in section taken along lines 2—2 in FIG. 1.

Referring to the accompanying drawings wherein like reference numbers refer to like elements, a telephone message device, generally referred to as device 10, is shown designed for making and recording written telephone messages. Although the device 10 will be described as being used to make and record telephone messages, it should be understood that the device 10 could be used to make and record other types of written information.

The device 10 comprises a box structure 28 which houses an exchangeable roll 12 of two layer duplicating recording paper 14. During use, the duplicating recording paper 14 is unrolled from the roll 12 and advanced through the box structure 28 along the fore to aft axis 85 in the direction shown in FIG. 2. The user writes a telephone message on the top sheet 14(*a*) of the duplicating recording paper 14 as it passes through the window area 38 located on the front cover plate 36. After writing the telephone message, the user then uses an advancement means comprising in the preferred embodiment a handle 50, which rotates a sleeve member 57 which collects the bottom sheet 14(*b*) thereon. While the bottom sheet 14(*b*) is collected on sleeve member 57, the duplicating recording paper 14 is pulled and advanced through the box structure 28. As the bottom sheet 14(*b*) is collected on the sleeve member 57 a collection spool 56 is formed inside the box structure 28. After all of the bottom sheet 14(*b*) has been collected on sleeve member 57, the collection spool 56 may be removed from the box structure 28 and stored in a convenient location for later retrieval. A new roll 12 of duplicating recording paper 14 and a new sleeve member 57 is then placed in the box structure 28.

In the preferred embodiment, box structure 28 is a relatively small, compact, rectangular-shaped object capable of being conveniently used on a desk top near the telephone. Box structure 28 comprises a vertical left side 31, a vertical right side 32, a vertical back side 33, a vertical front side 34, and a horizontal bottom surface 35. The front portion 29 of the box structure 28 is covered with a front cover plate 36 while rear portion 30 of the box structure 28 is covered by a rear cover plate 41. In the preferred embodiment, box structure 28 is made of durable, lightweight material, such as polystyrene synthetic resin or some other suitable material, and measures approximately 8 inches (L)×5¼ inches (W). The box structure 28 also measures approximately 2½ inches in height along back side 33 and 1 inch in height along front side 34. Each vertical left and right side 31 and 32, respectively, has an upper diagonal edge which slopes upwardly from front side 34 towards back side 33 at approximately 30 degrees from the horizontal axis. The top edges of the vertical sides are horizontal and parallel to bottom surface 35.

The front cover plate 36 is pivotally attached over the front portion 29 of box structure 28 to two integrally attached front stems 37 that extend outwardly from the left and right side 31 and 32, respectively, near front side 34. The front cover plate 36 is designed to hold the duplicating recording paper 14 inside the box structure 28 and against writing surface 20. The front cover plate 36 has a rearward extending edge 40 which when lifted upward, provides access to the writing surface 20 and the interior of the box structure 28.

Figure 3:
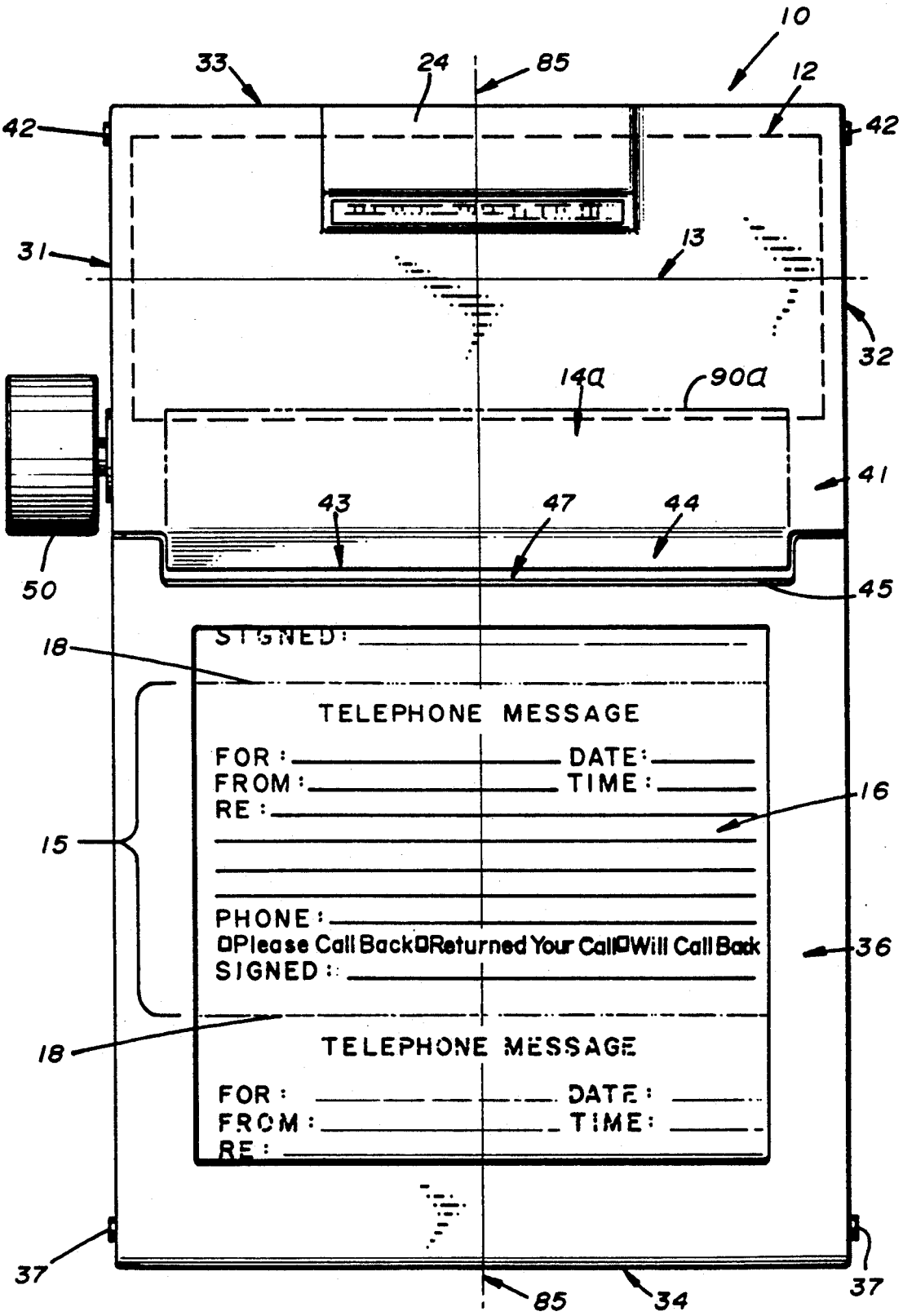
FIG. 3 is a top plan view of the device.
Figure 4:
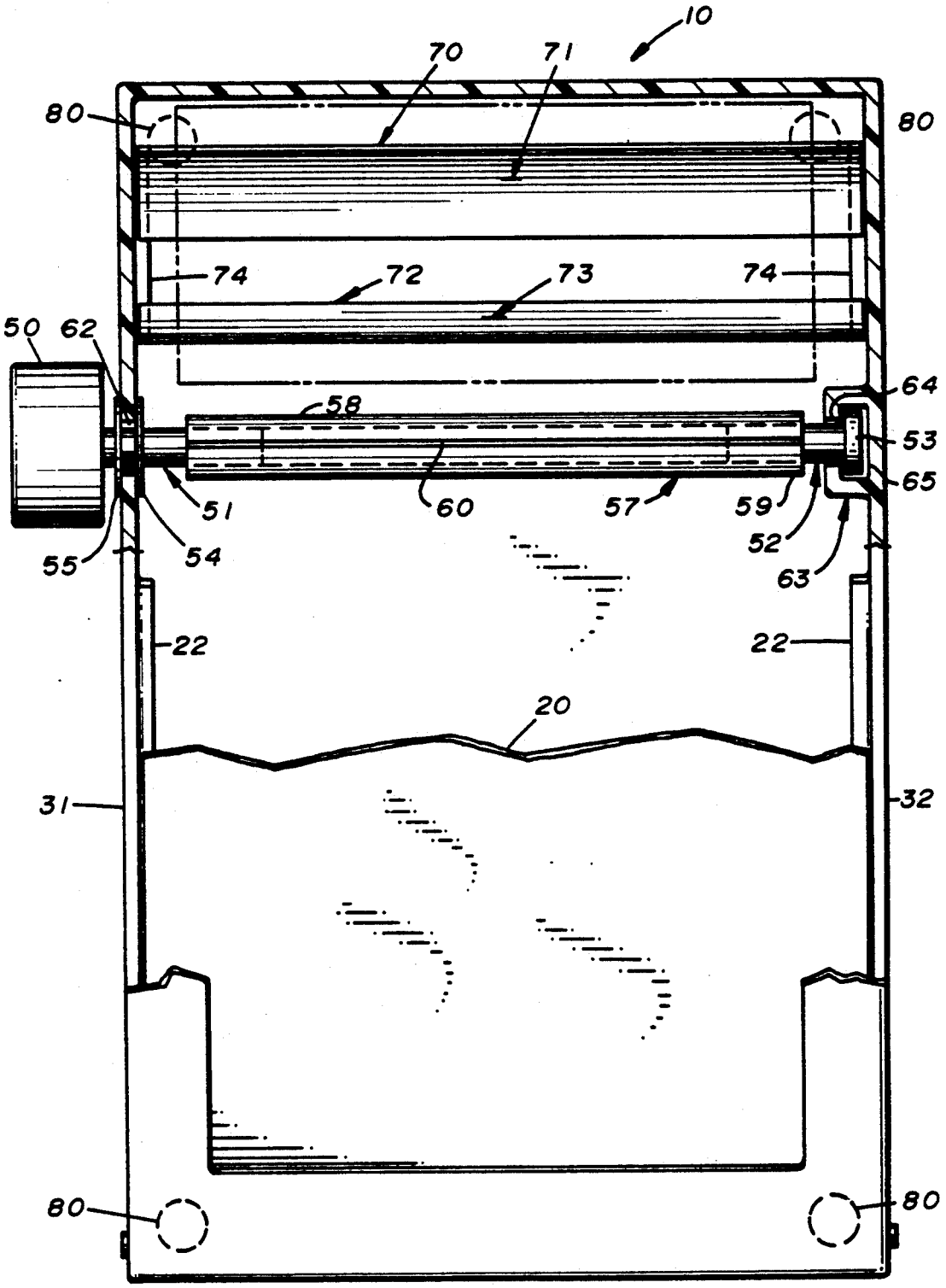
FIG. 4 is a top plan view of the device partially broken away.

As shown in FIGS. 1, 3, and 4, located centrally on the front cover plate 36 is a window area 38. As discussed further below, the window area 38 allows the user to write a message on the message outlines 15 located on the section of duplicating recording paper 14 as it passes therethrough. As shown in FIG. 3, the rearward extending edge 40 is manufactured in a cutout on the front cover plate 36. The rearward extending edge 40 may be sharpened to create a cutting edge 45 which is used to tear the top sheet 14(*a*) away from the bottom sheet 14(*b*) after recording a message.

As shown in FIG. 2, a flat writing surface 20 is attached over the front portion 29 of the box structure 28 just below the front cover plate 36. Writing surface 20 provides a flat, hard support surface for writing the telephone messages. The front surface 21 of the writing surface 20 is smooth and half-circular in cross-section which enables the duplicating recording paper 14 to advance smoothly thereover during use. The two longitudinal edges of the writing surface 20 parallel to axis 85 are supported by lip structures 22 which extend inwardly from each vertical side 31 and 32 just below and parallel to the adjacent diagonal edges. Writing surface 20 is made of smooth sheet metal or some other material capable of withstanding the downward forces exerted during writing.

The rear cover plate 41, which covers the rear portion 30, is pivotally attached to two integrally attached back stems 42 located on the outside surface of left and right surfaces 31 and 32, respectively, near back surface 33. The rear cover plate 41 pivots upwardly around back stems 42 so that user may gain access to the interior of the box structure 28. Such access allows the user to insert a new roll 12 of duplicating recording paper 14 and a new sleeve member 57 and to remove the collection spool 56 during use. As shown in FIG. 3, the forward extending edge 43 is complimentary in shape to the rearward extending edge 40 of the front cover plate 36. An optional downward sloping tongue member 44 may be attached or manufactured on the rearward extending edge 40. When the front and rear cover plates 36 and 41, respectively, are closed on the box structure 28, tongue member 44 extends downward and slightly below cutting edge 45. During use the tongue member 44 acts to separate the top sheet 14(*a*) from the bottom sheet 14(*b*).

The duplicating recording paper 14 comprises two-layered "NCR" duplicating paper comprising a top sheet 14(*a*) and a continuous bottom sheet 14(*b*) each having a plurality of messages outlines 15 printed thereon. The duplicating recording paper 14 is sufficiently wide to cover the writing surface 20 during use. In the preferred embodiment, the duplicating recording paper 14 measures approximately 5 inches (W)×18 yards (L). A plurality of message outlines 15 are printed across the duplicating recording paper 14. Each message outlines measures approximately 2½ inches from top to bottom. This produces approximately 275 to 300 message outlines 15 per roll 12. The top and bottom sheets 14(*a*) and 14(*b*), respectively, are registered so that the message outlines 15 printed on the top sheet 14(*a*) are aligned with the message outlines 15 printed on the bottom sheet 14(*b*). In the preferred embodiment the device 10 is designed for recording telephone messages, therefore the message outlines 15 contain information 16 for recording telephone messages. As shown, such information may include who the message is for; who the message is from; date; time; subject matter; and etc.

To separate the written messages from the top sheet 14(*a*), perforated lines 18 are manufactured transversely across the top sheet 14(*a*) between each message outline 15.

As mentioned above, the bottom sheet 14(*b*) is collected on the sleeve member 57 housed inside the box structure 28. To collect the bottom sheet 14(*b*) on the sleeve member 57, an advancement means is provided. In the preferred embodiment, shown more clearly in FIG. 4, the advancement means comprises a handle 50 which, when manually turned, rotates sleeve member 57. Handle 50 is attached to a first stem element 51 which slidingly engages the first end of the sleeve member 57. An inner washer 54 and outer washer 55 are spaced apart and rigidly fixed to the first stem element 50. The distance between the inner washer 54 and the outer washer 55 on the first stem element 51 is approximately equal to the thickness of the left side 31. During use, the first stem element 51 sliding engages a vertical slot 62 manufactured on left side 31.

A second stem element 52 sliding engages the second end 59 of sleeve member 57. Located on the distal end of the second stem element 52 is a rounded head 53 which slidingly engages the vertically aligned keyway 65 manufactured inside the stem guide 63 formed on the inside surface of the right side 32. A vertical slot 64 is manufactured on the inside wall of the stem guide 63 which enables the second stem element 52 to be inserted and selectively rotated therein. The diameter of head 53 is slightly larger than the width of vertical slot 64 thereby enabling the second stem element 52 to be retained therein. The vertical slot 62 located on left side 31 is manufactured to and across from vertical slot 64.

An attachment means is provided to attach the leading edge (not shown) of the bottom sheet 14(*b*) to the sleeve member 57. In the preferred embodiment, a longitudinal slot 58 is manufactured on the longitudinally axis of sleeve member 57 in which the leading edge of the bottom sheet 14(*b*) is inserted to attach the bottom sheet 14(*b*) to the sleeve member 57 in a manner similar to the method used to attached a film leader to an empty film spool.

After the handle 50 has been attached to the first sleeve member 57 and the leading edge of bottom sheet 14(*b*) has been attached to slot 60, the sleeve member 57 placed inside the box structure 28.

The roll 12 of duplicating recording paper 14 is housed in the rear portion 30 of the box structure 28 beneath the rear cover plate 41 and below sleeve member 57. The roll 12 is positioned in the box structure 28 with its longitudinal axis 13 perpendicular to the fore to aft axis 85 of box structure 28 as shown in FIG. 3. As shown in FIGS. 1 and 4, a rear paper support 70 and a front paper support 72 hold roll 12 above the bottom surface 35. The upper surfaces 71 and 73 of the rear paper support 70 and the front paper support 72, respectively, are curved upward in a concavely manner to conform generally to the rounded, outer shape of the roll 12. Vertical edge supports 74 are attached or manufactured along the inside surface of the left and right sides 31 and 32, respectively, which hold paper supports 70 and 72, respectively, thereto.

An optional information panel 24 is attached to the outer surface of the rear cover plate 41 to provide useful information to the user during use. In the preferred embodiment shown in FIG. 1, the information panel 24 has a viewing surface 25 which contains a battery-operated LCD date 26 and time indicator 27.

As shown in FIG. 2, four optional legs 80 made of flexible support material, such as latex or rubber, are attached to the bottom surface 35 near each corner of bottom surface 35.

During use, the front and rear cover plates 36 and 41, respectively, are pivoted upwardly to open box structure 28. Roll 12 of duplicating recording paper 14 is then placed in the box structure 28 over rear and front paper supports 70 and 72. The duplicating recording paper 14 is unwound from roll 12 and extended between supports 70 and 71 and across bottom surface 35. The leading edge 90 of the duplicating recording paper 14 is then pulled around the front surface 21 of writing surface 20 and pulled upward and rearward over the writing surface 20. The front cover plate 36 is then pivoted downwardly to close over the front portion 29 of the box structure 28. As the front cover plate 36 is closed, the position of the duplicating recording paper 14 is adjusted on writing surface 20 so that message outline 15 on the top sheet 14(*a*) is exposed through the window area 38.

After the duplicating recording paper 14 has been placed over the writing surface 20, it is then pulled upwardly approximately three inches. The leading free edges and of the top and bottom sheets 14(*a*) and 14(*b*), respectively, are then pulled apart and separated. The leading edge of the bottom sheet 14(*b*) is then inserted into the longitudinal slot 60 located on sleeve member 57. Sleeve member 57 is then rotated to wind and securely attach the bottom sheet 14(*b*) thereto. The first and second stem elements 51 and 52, respectively, are attached to the first and second ends 59, respectively, of sleeve member 57. The round head 53 of the second stem element 52 is then inserted into the vertical keyway 65 and first stem element 51 is inserted into the vertical slot 64 located on side surface 31. Handle 50 is then rotated to take up any slack in bottom sheet 14(*b*).

After the bottom sheet 14(*b*) has been attached to the sleeve member 57 and the sleeve member 57 has been attached between the sides 31 and 32, the rear cover plate 41 is pivoted downward to close over the rear portion 30 of the box structure 28. As the rear cover plate 41 is closed, the user holds the leading edge 90(*a*) of the top sheet 14(*a*) upward so that the tongue member 44 is positioned between the top and bottom sheets 14(*a*) and 14(*b*), respectively, as it moves downward towards cutout 39. When both the front and rear cover plates 36 and 41, respectively, are closed, the tongue member 44 extends forward, downward, and slightly below cutout 39. The top sheet 14(*a*) of the duplicating recording paper 14 is extended through the paper slot 47 formed between the rearward extending edge 40 and the forward extending edge 43. By pulling the top sheet 14(*a*) upward against the forward extending edge 43, the user may easily tear the message outline 15 along a perforated line 16 located between the message outlines 15.

Using the device 10 disclosed above, a method for recording and storing written telephone messages is also provided The method comprises the following steps: (1) attaching one end of a bottom sheet 14(*b*) of a roll 12 of duplicating recording paper 14 having top 14(*a*) and bottom sheets 14(*b*) to the sleeve member 57 on a collection spool 56; (2) advancing the sleeve member 57 so that a portion of top sheet 14(*a*) of the duplicating recording paper 14 is unrolled from the roll 12; (3) writing a telephone message on the exposed portion of the top sheet 14(*a*); (4) rotating the collection spool 56 to unroll a new section of duplicating recording paper 14; (5) removing the portion of the top sheet 14(*a*) of the duplicating recording paper 14 having the telephone message written thereon and delivering it to the intended receiver; (6) repeating steps 2 through 5 until all of the bottom sheet 14(*b*) of duplicating recording paper 14 has been unrolled from the roll and collected onto the collection spool 56.

In compliance with the statute, the invention has been described in language more or less specific as to structural features. It is to be understood, however, that the invention is not limited to the specific features shown since the means and construction herein disclosed comprise a preferred form of putting the invention into effect. The invention is, therefore, claimed in any of its forms or modifications within the legitimate and valid scope of the appended claims, appropriately interpreted in accordance with the doctrine of equivalents.

INDUSTRIAL APPLICABILITY

This invention will find wide spread use in the home and business office industries in which handwritten information is recorded, transferred, and stored for later use. This invention may also find wide spread use in the other industries, such as the medical and educational industries, in which handwritten information is also recorded, transferred, and stored for later use.

I claim:

1. A telephone message recording device, comprising:

a. a box structure comprising a rear surface, a front surface, and a bottom surface, said box structure having a front portion, a rear portion, and a fore to aft axis.

b. a flat writing surface attached across said front portion of said box structure;

c. a front cover plate pivotally attached to said box structure over said front portion and said writing surface, said front cover plate having a window area formed thereon which exposes a section of said writing surface when said front cover plate is positioned over said front portion of said box structure, said front cover plate having a rearward extending edge;

d. a rear cover plate pivotally attached to said box structure over said rear portion, said rear cover plate having a top surface and a forward extending edge;

e. a roll of duplicating recording paper housed inside said box structure, said roll of duplicating recording paper being positioned inside said box structure so that its longitudinal axis is aligned perpendicular to the fore to aft axis of said box structure, said roll of duplicating recording paper capable of being unrolled inside said box structure and advanced in a direction parallel to said fore and aft axis and along said bottom surface and over said writing surface, said duplicating recording paper including a top sheet and a bottom sheet each having a plurality of message outlines printed thereon, said top sheet and said bottom sheet being aligned so that each said message outline on said top sheet is registered with one said message outline on said bottom sheet;

f. a sleeve member housed inside said box structure, said sleeve member having an attachment means capable of attaching said leading edge of said bottom sheet to said sleeve member, and;

g. an advancement means attached to said box structure capable of rotating said sleeve member.

2. A device as recited in claim 1, wherein said rearward extending edge of said front cover plate and said forward extending edge of said rear cover plate form a paper slot when said front cover plate and said rear cover plate are in the closed position on said box structure.

3. A device as recited in claim 2, further including a cutting edge formed along said rearward extending edge of said front cover plate.

4. A device as recited in claim 3, wherein said message outlines in said top sheet are separated by perforated lines.

5. A device as recited in claim 3, wherein said message outlines contain information for recording telephone messages.

6. A device as recited in claim 5, further including an information panel attached to said box structure.

7. A device as recited in claim 6, wherein said information panel has a date and a time indicator.

* * * * *